US007140199B2

(12) United States Patent
Behr

(10) Patent No.: US 7,140,199 B2
(45) Date of Patent: Nov. 28, 2006

(54) MOUNTING SYSTEM FOR CUT STONES

(75) Inventor: Ehud Behr, New York, NY (US)

(73) Assignee: Suberi Brothers, New York, NY (US)

( * ) Notice: Subject to any disclaimer, the term of this patent is extended or adjusted under 35 U.S.C. 154(b) by 0 days.

(21) Appl. No.: 11/100,264

(22) Filed: Apr. 5, 2005

(65) Prior Publication Data

US 2005/0217316 A1 Oct. 6, 2005

Related U.S. Application Data

(60) Provisional application No. 60/560,139, filed on Apr. 6, 2004.

(51) Int. Cl.
*A44C 17/02* (2006.01)

(52) U.S. Cl. ..... 63/27; 63/26; 63/30

(58) Field of Classification Search ..... 63/27, 63/26, 28, 29.1, 29.2, 30, 31
See application file for complete search history.

(56) References Cited

U.S. PATENT DOCUMENTS

| | | | | | |
|---|---|---|---|---|---|
| D97,606 | S | * | 11/1935 | Klebanoff | D11/92 |
| D108,551 | S | * | 2/1938 | Rufeisen | D11/92 |
| 2,172,613 | A | * | 9/1939 | Hirsch | 63/26 |
| 2,774,231 | A | * | 12/1956 | Peterson | 63/28 |
| 6,532,765 | B1 | * | 3/2003 | Hurwitz | 63/26 |
| 6,772,580 | B1 | * | 8/2004 | Seliktar | 59/80 |
| 6,862,898 | B1 | * | 3/2005 | Seliktar | 63/37 |

* cited by examiner

*Primary Examiner*—Robert J. Sandy
*Assistant Examiner*—David Reese
(74) *Attorney, Agent, or Firm*—Michael J. Hughes; Intellectual Property Law Offices

(57) ABSTRACT

A mounting system for cut stones is provided in the form of a setting (10) adapted to enclose, support and visually enhance a cut stone (12) such as a princess cut diamond (18). The preferred embodiment (10) has concave exterior sidewalls (14) enclosing a mounting aperture (16) for receiving the stone, and a vertically convex upper surface (68) which overlaps a portion of the stone. Sharply tapered apexes (70) virtually extend the corners of the stone and reflective materials help enhance the apparent size and brilliance of the stone. The setting (10) is adapted for use in various types of jewelry.

17 Claims, 4 Drawing Sheets

MOUNTING SYSTEM FOR CUT STONES

The following claims priority from a provisional patent application 60/560,139, filed 06, Apr. 2004 to the same inventor.

TECHNICAL FIELD

The present invention relates generally to jewelry and more specifically to jewelry and gem mounting techniques, particularly those relating to princess cut stones.

BACKGROUND ART

Many different gem-mounting techniques have been devised to enhance the brilliance of stones, such as diamonds. Most commonly used jewelry settings have prongs, a bezel setting, or a channel setting, to hold the diamond into place. Most jewelry settings are designed to display the brilliance of the stone without obscuring the scintillations of the stone. The brilliance of a stone is created by the cut of the stone, the clarity rating of the stone with respect to imperfections, the color of the stone with respect to impurities, and the carat weight. Particularly, the cut and symmetry of the stone and respective symmetrical facets on the stone will draw out imperfections and/or impurities within the stone.

Existing jewelry settings rely on a larger stone to increase the brilliance of the jewelry piece. Although other inexpensive stones are available, the degree of brilliance in significantly decreased. An alternative jewelry setting known as an invisible setting gives the illusion the stone is larger than it appears and only emphasizes brilliance with a seemingly nonexistent setting.

Numerous other alternatives to create a similar brilliant effect exist where an inexpensive substitute for expensive stones may be used. However, the use of inexpensive substitutes, such as cubic zirconium, decreases the value of the jewelry piece. Accordingly, a need remains for new approaches to setting stones emphasizing brilliance of the stone and a unique jewelry setting to complement the brilliance of the stone.

DISCLOSURE OF INVENTION

Accordingly, it is an object of the present invention to provide a jewelry setting for stones, such as diamonds, to enhance the brilliance of the stone.

Another object of the invention is to provide a unique, prominent jewelry setting with greater brilliance for stones, such as diamonds, to cause the stones to appear larger in apparent size.

A further object of the present invention is to provide a brilliance enhancing setting which is adaptable for incorporation into a wide variety of jewelry items, from rings to pendants to earrings.

Still another object of the invention is provide a setting which provides a consistent enhancement to apparent brilliance of a variety of stones, effectively improving the apparent quality of the stone.

Briefly, one preferred embodiment of the present invention uses a jewelry setting with four concave external curvatures adapted to hold the stone. The setting provides sharply tapered apex points extending outward from the stone along natural apexes of the stone itself. The curvatures of the upper surfaces of the setting reflect light and provide a visual enhancement, which effectively enhance the apparent brilliance of the stone by elongating the symmetry of the vertical axis. The stone is set into the center of the curvatures, which act to capture and diffract light through the stone. The preferred embodiment is adapted particularly for use with square cut (Princess cut) diamonds.

An advantage of the present invention is that the four concave curvatures of the bezel setting hold a stone, such as a diamond, and enhance the brilliance of the stone by giving an illusion that a larger stone is set into the jewelry.

Another advantage of the present invention is to provide a mounting that does not obscure or detract from the appearance of a well-cut quality stone.

Still another advantage of the present invention is that the mounting emphasizes the exposure of the top facets of the stones and the symmetrical cuts of the stone.

A further advantage of the present invention is that the mounting displays a multifaceted symmetrical stone in a more brilliant manner.

Yet another advantage of the present invention is that it provides a-visually attractive appearance from all angles, including those where the stone itself cannot be seen.

These and other objects and advantages of the present invention will become clear to those skilled in the art in view of the description of the best presently known modes of carrying out the invention and the industrial applicability of the preferred embodiments as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
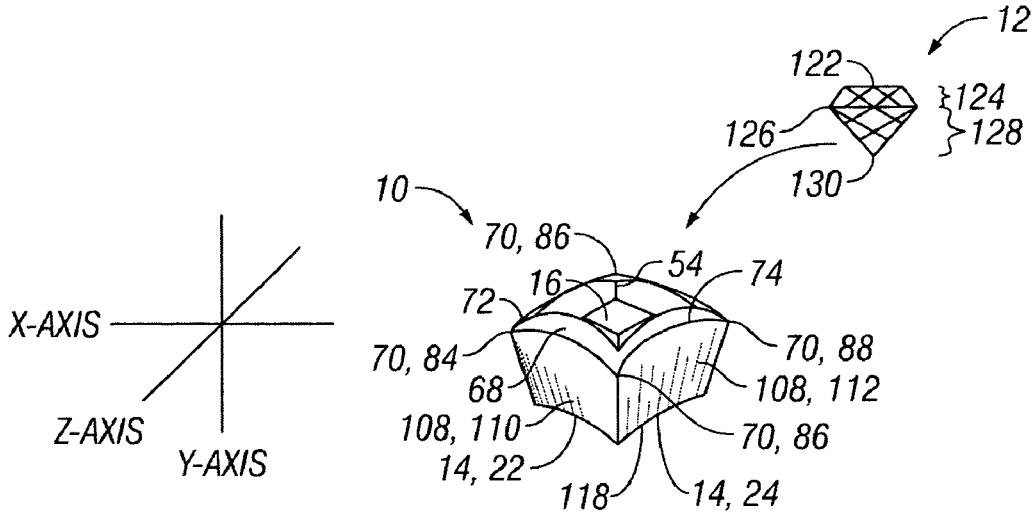
FIG. 1 is a perspective view of the mounting system of the present invention, shown with a placement of a stone into the mounting system.

A preferred embodiment of the present invention is a structure adapted to enhance the brilliance of a princess cut stone, specifically a diamond. As illustrated in the various drawings herein, a form of this preferred embodiment of the inventive device is mounting system designated by the general reference character 10. The invention is intended for use in jewelry.

Referring now to FIG. 1, a preferred embodiment of the mounting system 10 and a stone or diamond (stone) 12 is shown in perspective view, including four symmetrical concave sidewalls (sidewall) 14 and an aperture 16 at the top of the mounting system 10. The stone type for which the preferred embodiment is especially suited for a stone possessing a square aspect, such as a princess cut stone 18. Other stone types with symmetry along the x-axis and/or z-axis, such as a round cut stone 20, may be placed into the mounting system as well. In a typical application, the stone 12 is a Princess cut diamond (as illustrated apart from the stetting in FIG. 1).

The mounting system 10 (also sometimes referred to as a "bezel setting" or "setting") uses visually reflective metals such as white gold, silver, platinum, and the like. The setting 10 is integrally formed to include four substantially identical sidewalls 14. The four concave-exterior sidewalls 14 include: a first sidewall 22, a second sidewall 24, a third sidewall 26, and a fourth sidewall 28. Each sidewall 14 has an internal structure 30 and an external structure 32. The external structure 32 of each sidewall is concave to the sides and convex on the upper portion, while the internal structure 30 is characterized by linear segments. The internal structure 30 is designed to tightly hold the stone 12 in the setting 10 as later demonstrated in FIG. 3. The external structure 30 encompasses a rhombus-shaped design with the four concave sidewalls 14 as shown in FIG. 1 and later shown in FIG. 2.

The internal structure 28 consists of four ledges 34 and four inner support walls 36 (one of each to each sidewall 14). Each ledge 34 is significantly thicker in width than the respective support wall 36. The four ledges 34 include: a first ledge 38, a second ledge 40, a third ledge 42, and a fourth ledge 44. The four inner support walls 36 include: a first inner support wall 46, a second inner support wall 48, a third inner support wall 50, and a fourth inner support wall 52. The juncture points where each ledge 34 meets another ledge 34 are the four inner vertices 54. The four vertices 54 are illustrated in the top view of FIG. 2. The four inner vertices 54 include: a first inner vertex 56, a second vertex 58, a third vertex 60, and a fourth vertex 62. Again, these are indistinguishable from each other in structure and function and correspond relatively closely to the corresponding corners or vertices of the stone 12. The internal structure 30 is further explained in the discussion relating to FIG. 3.

The external structure 32 of each sidewall 14 has an upper section 64 and a lower section 66. The upper section 64 has four external top surface sections 68, four apex points 70, four upper edges 72, and four external horizons 74.

The four external top sections 68 are essentially identical and include: a first top section 76, a second top section 78, a third top section 80, and a fourth top section 82. With respect to the upper surface and the inner edge the sections are convex. As is particularly seen in FIG. 2 the top sections 68 overlap the stone 12 in the center sections thereof. The overlap emphasizes the inner vertices 54 from a visual standpoint, making it appear sharper than if the inner edges of the top sections 68 were linear. This shaping and the reflectivity of the metal aid the brilliance enhancement of the setting 10.

The four apex points 70 occur at juxtaposition of the outer edges of the associated pairs of top concave sections 68 and include: a first apex point 84, a second apex point 86, a third apex point 88, and a fourth apex point 90. The four apex points 70 extend away from the visual corners of the stone 12 and continue the sharp appearance of the inner vertices 54 creating a linear point motif which appears to extend the boundaries and brilliance of the stone 12. To this end each apex point 70 merely extends a line of symmetry created by its respective inner vertex 54. Each line of symmetry traverses an upper edge 72 which is vertically convex if viewed from a side of the line of symmetry. The upper edge 72 is a convex border between adjacent top sections 68 connecting the inner vertex 54 to its respective apex point 70. The four upper edges 72 include: a first upper edge 92, a second upper edge 94, a third upper edge 96, and a fourth upper edge 98.

The four external horizons 74 are located at the nethermost region of the upper section 64. The four external horizons 74 include: a first horizon 100, a second horizon 102, a third horizon 104, and a fourth horizon 106.

The lower section 66 extends four external concave support sections 108 downward from the four external horizons 74 and the four apex points 70. The four external concave support sections 74 include: a first concave support section 110, a second concave support section 112, a third concave support section 114, and a fourth concave support section 116. The lower section 66 ends at the bottom 118 of the mounting system 10.

As illustrated in FIG. 1, the stone 12 has multiple facets 120 to create a brilliant effect. Sections of the stone 12 include the table 122 (located on the top surface of the stone), the crown 124, the girdle 126 (area dividing the crown and pavilion of the stone), the pavilion 128 (located on the lower section of the stone), and the culet 130 (the lowest point on the lower section of the stone).

The stone 12 is situated within the aperture 16 of the mounting system 10 as illustrated in FIG. 1. In fabrication of the system 10 the stone 12 is typically held in a wax support within a mold and the metal of the setting 10 is cast around the stone 12, thus permanently capturing the stone 12 within the setting 10. The arrangement is such that the culet 130 points down towards the bottom 118 of the bezel setting 10. In the preferred embodiment of the present invention, a princess cut stone 18 is utilized. The princess style is preferred because of its popularity, the square geometrical aspect of the cut (from a vertical perspective) and the faceting of the pavilion 128 which enhance brilliance. The sharp corners and linear edges of the princess cut are particularly emphasized by the visual enhancement provided by the line of symmetry of the upper edges 72 extending from the corners of the stone 12 through the respective inner vertices 54 and external apex points 70. Although other cuts of gems are less common, the principle logically extends to other geometric shapes with defined corners which can be emphasized.

Figure 2:
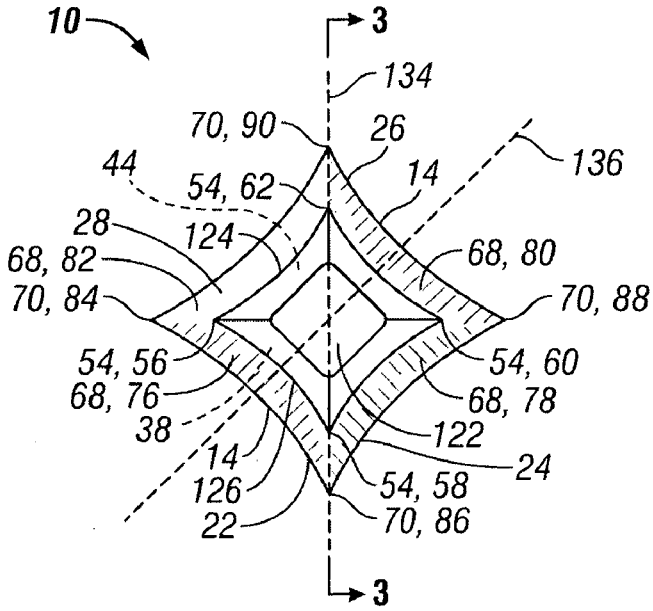
FIG. 2 is a top plan view of the mounting system of the present invention, shown with a stone set into place.

FIG. 2 illustrates a top view of the mounting system 10 with the stone 12 set into place. The table 122 and portions of the crown 124 of the stone 10 are facing the top of the mounting system 10. The four ledges 34 of the mounting system 10 cradle the girdle 126 of the stone 12, and expose the table 122 and portions of the crown 124 of the stone 12. As discussed earlier, portions of the crown are occluded by the inner edges of the top sections 68, to enhance the corners. As in FIG. 1, the lines of symmetry are exaggerated by upper edges 72 connecting the inner vertices 54 and the apex points 70. Also, the four top surface sections 68 are visible from the top view.

Since each sidewall 14 is identical, the cross-sectional views will maintain symmetry. The mounting system may be divided by the corner axis 134 or the bisecting axis 136

(located at the midpoint of the most concave section of the curvature). One such view is shown in FIG. 3 which illustrates a cross-sectional view of the mounting system 10 taken along one of the corner axes 134, with the stone 12 shown as installed.

Figure 3:
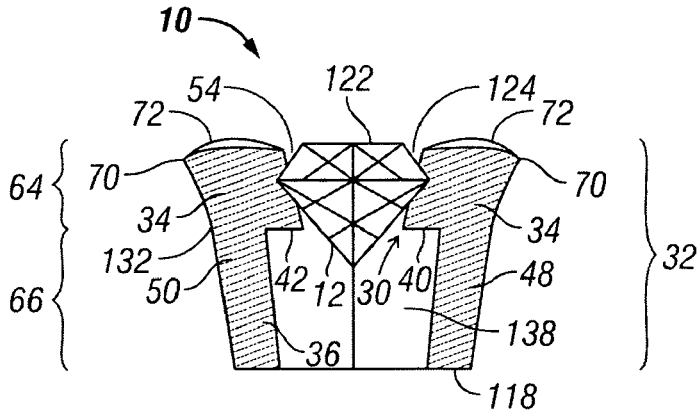
FIG. 3 is a cross-sectional view, taken along a corner axis, of the mounting system of the present invention, shown with a stone set into place.

As illustrated particularly in FIG. 3, the mounting system 10 securely holds the stone 12 in a niche 132 of each ledge 34 of the internal structure 30 and a respective upper section 68 of the external structure 32 as discussed with respect to FIG. 1. The niche 132 is formed by the impingement of the stone 12 into the mold when the setting 10 is cast. As shown in FIG. 3, each ledge 34 is significantly thicker than its respective inner support wall 36 to provide broad support for the pavilion 128 and a reflective background for the associated facets. The stone 12 is placed with the table 122 facing upwards and the culet 130 pointing down into a central hollow section 138 of the setting 10 (the aperture 16). The central hollow section 138 permits light to be captured and diffracted through the bottom 118 or through the stone 12. If the cut of the stone 12 is flawed, the configuration and reflective material of the mounting system 10 help to compensate for light lost. Even for an imperfect stone the setting 10 can redirect light to create and enhance a brilliant effect. This increases the apparent brilliance of the stone.

Also, the external structures 32 of FIG. 3 demonstrate the extension of the apex points 70 and the convex aspect of respective top sections 68. As discussed above, each apex point 70 is merely an extension of the line of symmetry from its respective inner vertex 54 and further extended by its respective upper edge 72.

Figure 4:
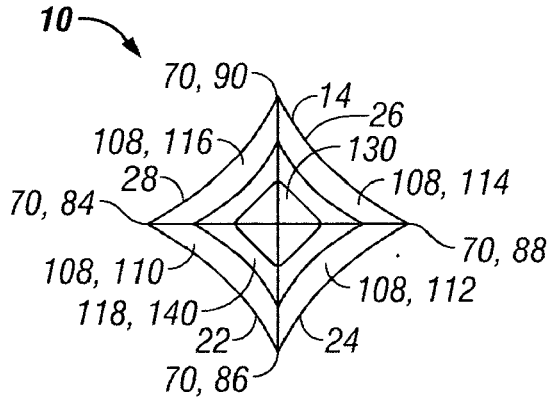
FIG. 4 is a bottom plan view of the mounting system to the present invention.

FIG. 4 illustrates a bottom view of the mounting system 10. A base 140 of the bottom 118 of the mounting system 10 is provided and is connected to the concave support sections 108. In FIG. 4, the first concave support section 110, second concave support section 112, third concave support section 114, and the fourth concave support section 116 are illustrated. Also, the bottom view illustrates the four horizons 74 and the four apex points 70 as previously shown in FIGS. 1–3. Further, an inverted view of the pavilion 128 and culet 130 of the stone 12 can be seen through the bottom 118 of the mounting system 10.

Figure 5:
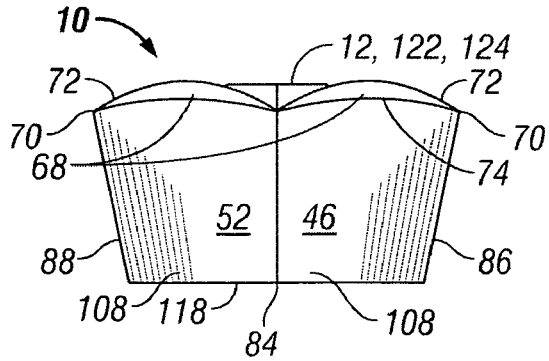
FIG. 5 is a side elevational view of the mounting system, shown from the same angle as FIG. 3.

FIG. 5 illustrates a corner edge side elevational view (same as FIG. 3 without the cross section) of the mounting system 10 with the stone 12 in place. In FIG. 5, the table 118 and a portion of the crown 124 of the stone 12 are shown to extend vertically above the level of the setting so the stone may be seen from the edge. The curvature of the upper surface of the top sections 68 is illustrated here, as is the lower positioning of the apex 70 with respect to the upper surface 72.

The remaining figures are provided to illustrate the adaptability of the mounting system 10 for incorporation into various jewelry pieces. Each of the remaining figures exemplify an appropriate application of the invention, while none actually show significant differences in the basic setting 10.

Figure 6:
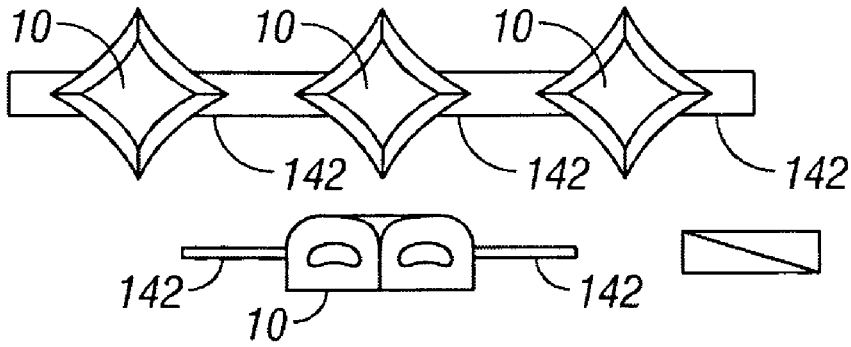
FIG. 6 illustrates an exemplary embodiment of a jewelry design incorporating the mounting system.

FIG. 6 illustrates an exemplary embodiment of a jewelry design incorporating the mounting system 10. Here, a series of mounting systems 10 are incorporated into the jewelry setting for a bracelet or necklace. The mounting systems 10 position the corner axis 134 as the y-axis connected to metal 142 merged along the x-axis.

Figure 7:
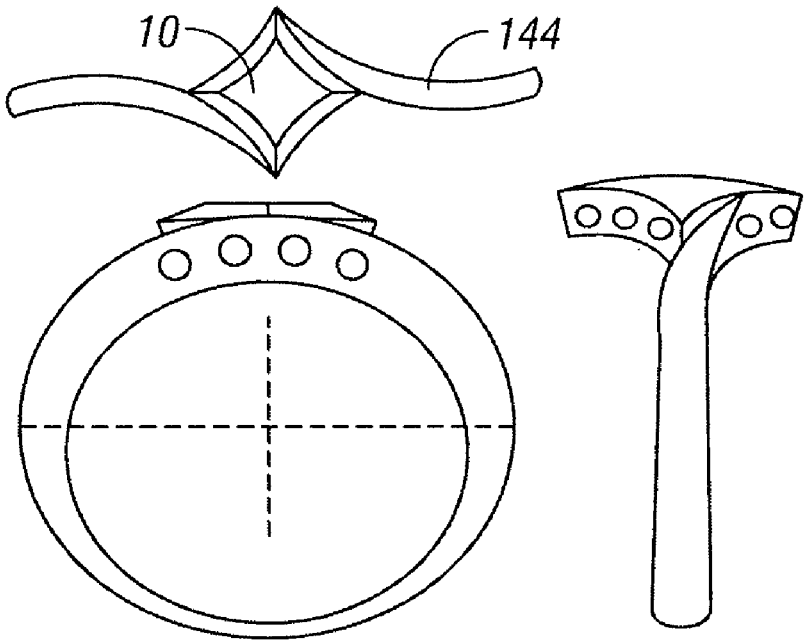
FIG. 7 illustrates another exemplary embodiment of a jewelry design incorporating the mounting system.

FIG. 7 illustrates another exemplary embodiment of a jewelry design incorporating the mounting system 10. Here, the mounting system 10 is placed into a ring 144. Once again, the mounting system 10 positions the corner axis b as the y-axis and contrasts the symmetrical lines of the facets 120 on the stone 12 with the x-axis of the ring 144.

Figure 8:
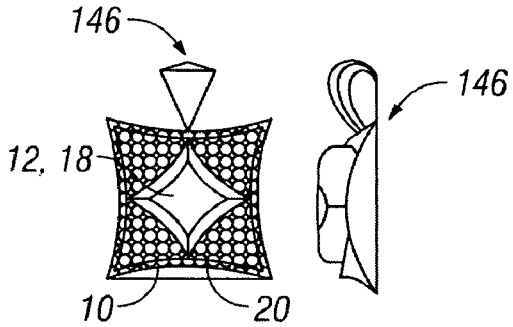
FIG. 8 illustrates yet another exemplary embodiment of a jewelry design incorporating the mounting system.

FIG. 8 illustrates yet another exemplary embodiment of a jewelry design incorporating the mounting system 10. Here, the mounting system 10 is placed in to the center of a pendant 146. Once again, the mounting system 10 positions the corner axis 134 as the y-axis. Round cut stones 20 surround the mounting system 10 and the princess cut stone 18 set into the mounting system 10, to further complement the brilliance of the stone 12.

Figure 9:
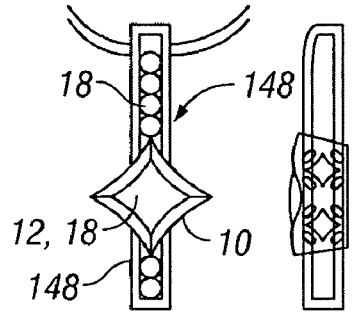
FIG. 9 illustrates still another exemplary embodiment of a jewelry design incorporating the mounting system.

FIG. 9 illustrates still another exemplary embodiment of a jewelry design incorporating the mounting system 10. This is another example in which the setting b is placed in a pendant 146. Once again, the mounting system 10 positions the corner axis 134 as the y-axis. The mounting system 10 has a princess cut stone 18 set into place with a series of round cut stones 20 set into channel settings 148, flanking the corner axis 134 of the apex points 70 of the mounting system b.

Figure 10:
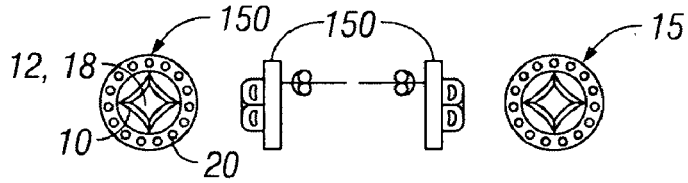
FIG. 10 illustrates an additional exemplary embodiment of a jewelry design incorporating the mounting system.

FIG. 10 illustrates an additional exemplary embodiment of the jewelry design incorporating the mounting system 10. Here, the mounting system 10 positions the corner axis 134 as the y-axis, as incorporated into earrings 150. Similar to FIG. 8, round cut stones 20 surround the setting 10.

Figure 11:
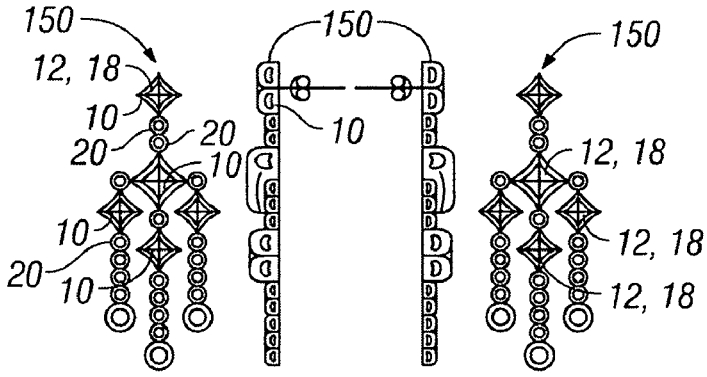
FIG. 11 illustrates another additional exemplary embodiment of a jewelry design incorporating the mounting system.

FIG. 11 illustrates another additional exemplary embodiment of the jewelry design incorporating the mounting system 10. Here, the mounting system 10 is incorporated into earrings 150 with a sophisticated design. Princess cut stones 18 and round cut stones 20 are both showcased in the jewelry design. Once again, the mounting system 10 positions the corner axis 134 as the y-axis. The jewelry design connects the apex points 70 of the mounting systems 10 to a series of jewelry settings for round cut stones 20 using different setting structures.

The dimensions of the setting 10 are dependent on the stone 12 selected. Molds may be constructed to correspond to the desired shapes and sized of diamonds, emeralds or other gems. The vertical proportional height of the setting 10 may also be adjusted, with the proportions of the stone taken into account, without significantly altering the enhancement effect.

Different metals may be utilized, as may different stones. However, the maximal apparent size and brilliance enhancement effects are accomplished when complementary colors are utilized. For example, for a typical white diamond, platinum, silver or white gold may be utilized, while yellow gold would be less effective. For a ruby or emerald, other tints of metals could be used.

The principal current versions of the aspects deal with square cut princess type diamonds. However at least rectangular or other geometric shapes with defined corners and linear sides will also benefit from the concepts of the invention.

While various embodiments have been described above, it should be understood that they have been presented by way of example only, and not as limitation.

INDUSTRIAL APPLICABILITY

The present invention is adapted for the principal use by jewelers and primary enjoyment by jewelry purchasers.

In a typical application of the preferred embodiment 10, the princess cut stone 18 is selected to set into a setting 10 adapted for installation in a jewelry piece. Dimensions and orientation will be selected to correspond with the particular stone and desired jewelry component. The stone will be placed into the mold and the setting 10 will be cast around the stone, thus permanently embedding the stone 12 in position.

The mounting system 10 will accommodate most gems, as designated by the jewelry design. The jewelry design is such that the rigid cuts of the facets 120 and square corners of a princess cut stone 18 will be enhanced by the continuity of lines in the X-axis and the Z-axis of the mounting system 10. The apex points 70 are such that they further extend the virtual appearance of each corner of the stone 12 by the inner vertices 54, through its respective upper edge 72, and continuing to the apex point 70. This creates an illusion of greater brilliance and larger size of the stone by extending the lines of symmetry of the facets 120 of the stone 10. Further, the mounting system 10 does not detract from the aesthetic design of the mounting system 10. If the stone 12 is improperly cut or has minor flaws, the mounting system 10 can capture light and reflect and refract "lost" light back through the stone 12 to provide a brilliant effect.

Similar to existing jewelry designs, smaller stones, such as round cut stones 20 may be used to complement the brilliance of the stone 12 set into the mounting system(s) 10 of the jewelry piece. The setting 10, as particularly illustrated in FIGS. 6–11, is adapted for use in many types of jewelry.

For the above, and other, reasons, it is expected that the mounting system of the present invention will have widespread industrial applicability. Therefore, it is expected that the commercial utility of the present invention will be extensive and long lasting.

I claim:

1. A mounting system for a square cut stone, comprising:

a setting in the form of a rhombus shape having four symmetrical concave-exterior sidewalls and an aperture enclosed by said sidewalls for containing the stone, said aperture being open to the top to expose an upper surface of the stone, a portion of each said sidewall overlapping a central portion of each side of the upper surface of the stone, wherein the juxtaposition of each said sidewall with an adjacent sidewall results in a apex extending outward from said aperture, each said apex being aligned with a respective corner of the stone to provide a visual extension of the corners of the stone, and the top surface of each said sidewall is convex along the portion overlapping the stone in order to emphasize each said apex.

2. The mounting system of claim 1, wherein each said sidewall is formed of an optically reflective material complimentary to the selected stone.

3. The mounting system of claim 1, wherein the stone is secured within niches formed on the interior of each said sidewall.

4. A setting adapted for supporting a faceted jewel having a regular geometric aspect with linear sides and corners, the setting comprising:

a number of sidewall members equal to the number of sides of the jewel, wherein;

each said sidewall is provided with a convex upper surface which extends over a portion of a respective one of the linear sides of the jewel, while overlapping minimally at the respective corners of the jewel.

5. The setting of claim 4, wherein each pair of adjacent sidewalls intersect to form an inner vertex at the respective corner of the jewel and an extended apex, each vertex and apex being linearly aligned with a corner axis of the jewel so as to provide virtual extension of the shape of the jewel.

6. The setting of claim 5, wherein each said sidewall is vertically convex on its upper surface so as to be higher in the center extent and lower at each respective apex, so as to expose the corner aspects of the jewel to side view.

7. The setting of claim 5, wherein the lateral external surface of each said sidewall is concave to further enhance the tapering of each said apex.

8. The setting of claim 4, wherein the setting is tapered from top to bottom.

9. The setting of claim 4, wherein the setting is constructed of metal complimenting the color of the selected jewel.

10. The setting of claim 4, wherein the setting is formed of optically reflective material to enhance the brilliance of jewel.

11. The setting of claim 4, wherein the horizontal thickness of said convex upper surface is small with respect to the jewel.

12. The setting of claim 4, wherein the jewel is supported within the setting such that the upper surface of the jewel is approximately vertically aligned with the highest point on each said sidewall.

13. A mounting system for cut stones having a plurality of sides, comprising:

a plurality, equal to the plurality of sides of the stone, of mutually symmetrical sidewall members arranged to frame an open aperture for receiving the cut stone; wherein each said sidewall includes:

a concave exterior surface;

an interior surface with a mounting ledge and a niche for receiving an edge of the cut stone and together securing the cut stone within said open aperture; and a vertically convex upper surface with a convex inner edge for overlapping a portion of the respective side of the stone.

14. The mounting system for cut stones of claim 13, wherein adjacent ones of said sidewalls intersect to form a sharply tapered apex, said apex being aligned to extend and enhance the respective corner of the stone.

15. The mounting system for cut stones of claim 14, wherein the upper surface of each said apex is vertically aligned below the upper surface of the cut stone.

16. The mounting system for cut stones of claim 13, wherein the plurality of sides and sidewalls is four and the stone is selected to be princess cut.

17. The mounting system for cut stones of claim 16, wherein the stone is a diamond.

* * * * *